US010252129B2

(12) United States Patent
Sutta et al.

(10) Patent No.: US 10,252,129 B2
(45) Date of Patent: Apr. 9, 2019

(54) STRUCTURE OF ACCESSORY ELEMENT FOR EQUIPMENT OF FLOORBALL TRAINING COURT AND USE OF IT FOR FORMATION OF FLOORBALL SIMULATOR

(71) Applicants: Peters Sutta, Riga (LV); Janis Leitans, Riga (LV)

(72) Inventors: Peters Sutta, Riga (LV); Janis Leitans, Riga (LV)

( * ) Notice: Subject to any disclaimer, the term of this patent is extended or adjusted under 35 U.S.C. 154(b) by 0 days.

(21) Appl. No.: 15/543,990

(22) PCT Filed: Feb. 8, 2016

(86) PCT No.: PCT/IB2016/050635

§ 371 (c)(1),
(2) Date: Jul. 15, 2017

(87) PCT Pub. No.: WO2016/128874

PCT Pub. Date: Aug. 18, 2016

(65) Prior Publication Data

US 2018/0001172 A1 Jan. 4, 2018

(30) Foreign Application Priority Data

Feb. 9, 2015 (LV) ..... P-15-11

(51) Int. Cl.

| | |
|---|---|
| ***A63B 69/00*** | (2006.01) |
| ***A63B 71/00*** | (2006.01) |
| ***A63C 19/06*** | (2006.01) |
| ***A63B 71/02*** | (2006.01) |
| ***A63B 69/38*** | (2006.01) |

(Continued)

(52) U.S. Cl.

CPC ..... *A63B 69/0024* (2013.01); *A63B 71/00* (2013.01); *A63B 71/022* (2013.01); *A63C 19/06* (2013.01); *A63B 69/38* (2013.01); *A63B 71/02* (2013.01); *A63B 2102/02* (2015.10); *A63B 2102/30* (2015.10); *A63B 2210/50* (2013.01)

(58) Field of Classification Search

CPC ..... A63B 69/02; A63B 49/02; A63B 71/02; A63B 63/00

USPC ..... 473/446, 532, 478, 82, 416; 124/16

See application file for complete search history.

(56) References Cited

U.S. PATENT DOCUMENTS 3,019,020 A * 1/1962 Cohn ..... A63D 5/08 473/114

3,838,677 A * 10/1974 Alvares ..... A63B 69/0026 124/16

(Continued)

*Primary Examiner* — Gene Kim

*Assistant Examiner* — Christopher Glenn

(74) *Attorney, Agent, or Firm* — Patshegen IP LLC; Moshe Pinchas

(57) ABSTRACT

The invention refers to the equipment of the training rink for floorball, manufacturing of exerciser structural element, applying concept of tennis racket stringing. Proposed design of subsidiary element for floorball rink arrangement characterized with that it is made as latticework formed by: two parallel end plates; several threaded rods as stiffening members; two elastic string structures disposed in two parallel planes, at that each of it presents one side of mentioned latticework and provided with:

Figure 1:
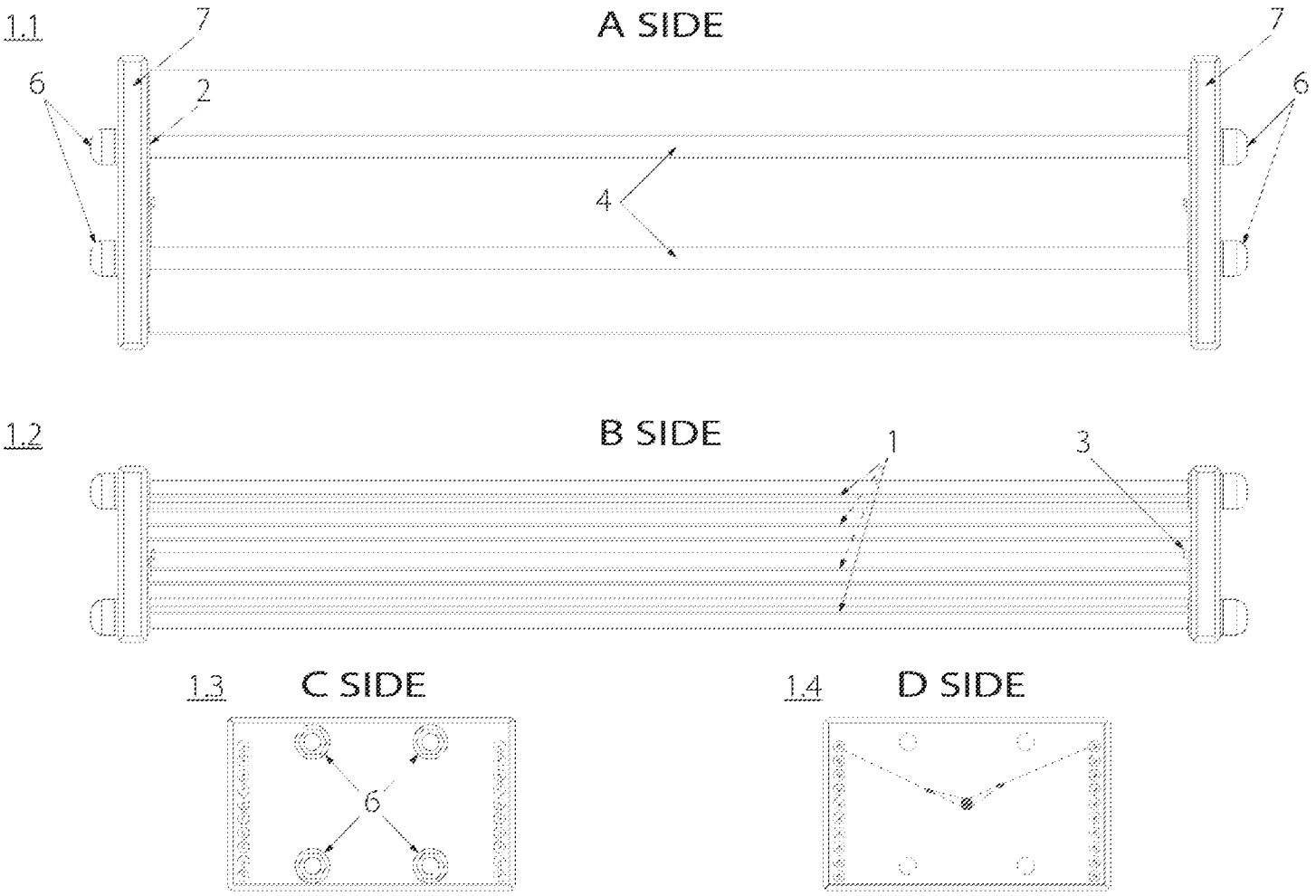

- holes for fastening threaded rods which assure rigidity and load bearing capacity of the subsidiary element frame structure;
- holes for criss-cross stringing in two parallel planes and string fastening at mentioned end plates independently one from another.

9 Claims, 3 Drawing Sheets

(51) Int. Cl.
*A63B 102/30* (2015.01)
*A63B 102/02* (2015.01)

(56) References Cited

U.S. PATENT DOCUMENTS

| | | | | | |
|---|---|---|---|---|---|
| 4,135,716 | A * | 1/1979 | Ginsburg | A63B 61/04 | 473/416 |
| 4,274,634 | A * | 6/1981 | Berluti | A63B 49/038 | 473/532 |
| 2015/0057113 | A1* | 2/2015 | Phillips | A63B 63/004 | 473/478 |

* cited by examiner

STRUCTURE OF ACCESSORY ELEMENT FOR EQUIPMENT OF FLOORBALL TRAINING COURT AND USE OF IT FOR FORMATION OF FLOORBALL SIMULATOR

The invention refers to the equipment of floorball rink, mainly to the arrangement of rink boards, manufacturing of its structural elements applying concept of tennis racket stringing.

16 information sources was found in the international database http://worldwide.espacienet.com, with "floorball" keyword. Among them, there was only one patent application WO03086556 (A1) "Dismountable/collapsible board design", applied on Oct. 23, 2003, referring arrangement of the floorball rink boarding, but others were related to the design of sticks used in the game. The mentioned floorball rink boarding design is formed of plate elements, which during boarding are connected edge to edge one after another and on disassembling are successively detached one from another. The design of mentioned elements is demonstrated in details in 15 figures. Substantial disadvantage of such elements is high consumption of materials and structural complexity as well as inconformity with functional features of floorball training process, particularly for the reason that this solution allows to practice ball shots only at inner side of the rink perimeter boarding.

Different modes of concept of tennis racket stringing are described in details in the webpage http://ww.faxs.org/sports-science/Sp-Tw/tennis-racquet-Constructions and http://en.wikipedia.org/wiki/racket (sports_equipment)# Rackets). Choice of particular stringing method is question of each interested knowledge and experience, at that alternatives are very wide, starting from rocket body materials, string materials, stringing patterns and methods of string fixing to the rocket body.

The invention aim is to use principle of tennis racket stringing for making subsidiary structural element of floorball training rink, with substantially reduced material use and therefore reducing elements weight, as well as facilitating elements joining between their ends and one over another, optionally inclined about the rink floor in arbitrary zones of the rink, where players can hone their skill, at that inside the rink, so using both sides of element comparing with only inner side in case of known perimeter boarding. Substance of the invention concerning subsidiary element design is defined in the claims 1 to 6 and concerning mode of the element use defined in claims 7 to 9.

Figure 2:
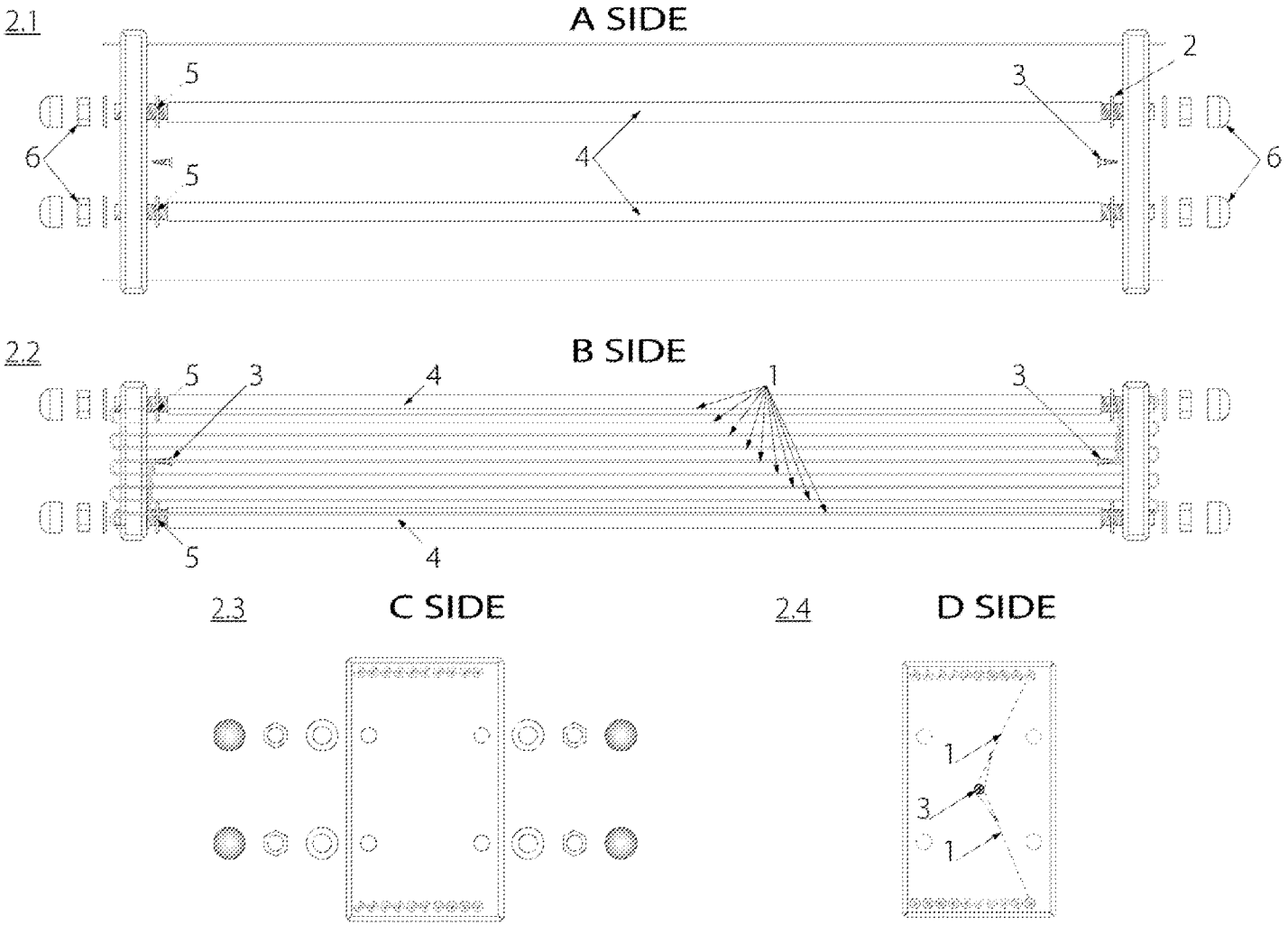
Figure 3:
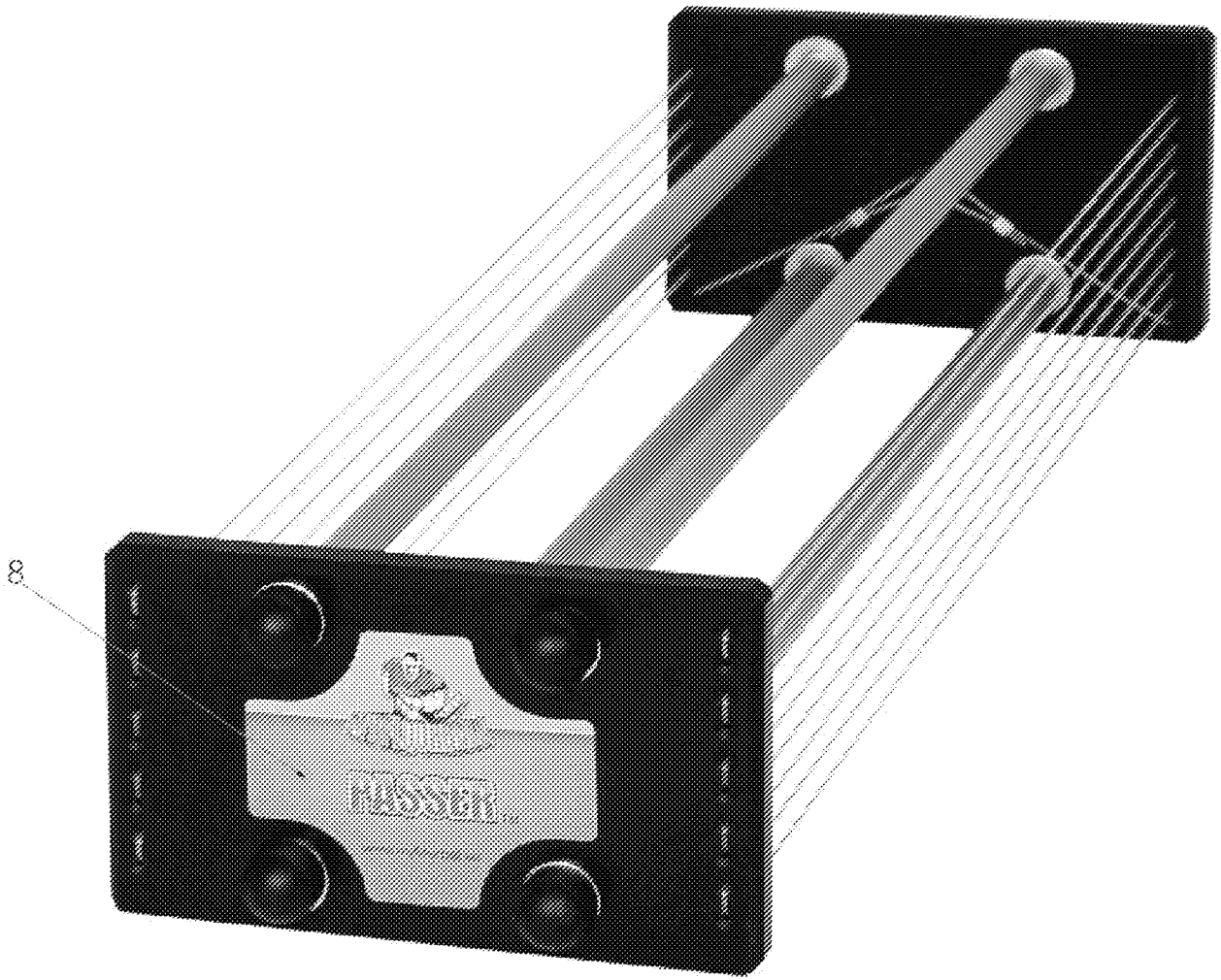

One of the possible alternatives of the invention implementation is illustrated in FIG. 1. and FIG. 2., at that:

FIG. 1 presents general view of rink arrangement with assembled subsidiary elements of proposed design, where: 1.1 is element's A-side top/bottom view; 1.2 is element's B-side front/back view; 1.3 is element's C-side right/left end view; 1.4 is element's D-side right/left ends view from inside;

FIG. 2 shows general view of rink arrangement with subsidiary elements of proposed design in assembling process, with that the structure parts of element are additionally depicted, where: 2.1 is element's A-side top/bottom view; 2.2 is element's B-side front/back view; 2.3 is element's C-side, right/left end view; 2.4 is element's D-side right/left ends view from inside;

FIG. 3 presents axonometric perspective of general view of rink arrangement with assembled. subsidiary elements of proposed design.

The following drawing indications of parts were used for defining proposed subsidiary element design:

1—string (2 pcs.),
2—aluminium string terminal (4 pcs.),
3—string fixing screw (2 pcs.),
4—aluminium tubes, covering threaded rods (4 pcs.),
5—threaded rod (4 pcs.),
6—lock nut, washer, decorative nut cap (4 sets),
7—end plate, fore example of PVC, (2 pcs.),
8—marking plate/brand label.

DETAILED DESCRIPTION OF THE PROPOSED TRAINING RINK ARRANGEMENT (a) Strings assure strong dap of the ball directed against subsidiary element side surface with string pattern. Linear reversed string distribution by the element length on the both sides of subsidiary element make possible for two players to practice game skill if the element is placed in the middle of the rink. String ends' eyes enforced with aluminium terminals. All string sections are parallel and recommended distance between them is 1 cm. The distance can be increased or reduced depending on the various circumstances. Recommended length of the strings between end plates is 75 cm, but it can be longer or shorter than recommended. The distance of the bottom string from the rink surface is 2 cm, but it can be bigger or smaller than recommended. Recommended number of strings' section is 9 and all they are parallel. At that the number of sections can be greater or fewer. Strings of 1 to 1.4 mm diameter can be as synthetic as well as natural, made of steel or polymer or textile cords. String diameter can be bigger or smaller than recommended. String ends' eyes are fixed to the end plates internal surface with a screws on both element ends.

(b) Aluminium terminals reinforce string ends' eyes. Recommended terminal dimension is 1 to 1.4 mm, but according to particular needs can be bigger or smaller relative to the recommended.

(c) String ends' eyes are fixed to internal surface of the end plates with screws.

(d) Aluminium tubes and their arrangement oppose the load of stringing. Recommended length of tubes is 75 mm and the recommended number of tubes in the element is 4 with distance between them 9 cm, and tube diameter 14 mm. Mentioned tubes' parameters: diameter, length, number and arrangement pitch can be greater or smaller than recommended. The distance between tubes is measured between tubes' axes.

(e) Threaded roads and their arrangement assure resistance of the proposed subsidiary element against load generated by stringing as well as by floorball balls strikes. Threaded roads rigidly fix both string keeping end plates at the ends of subsidiary element. Threaded rod recommended length and number are correspondingly 81 cm and 4 pieces. The rod can be longer or shorter, than recommended. The number of roads can also vary to suite particular need. Recommended diameter of the threaded rod 12 mm, but it also can be bigger o smaller than recommended. Recommended distance between threaded rods equal to 9 cm, measured between rods' axes. Mentioned distance can also be modified as necessary.

(f) Lock nuts fix the threaded rods, optionally covered with aluminium tubes, at the end plates and their number correspond the number of threaded rods used in the design.

(g) Washers being assembly components placed between the nut and end plate on the both plate sides. Eventual decorative caps on the lock nuts used to mask the nuts.

(i) Recommended dimensions of the plastic end plates forming subsidiary element ends and providing support surface for the strings are 12 cm×20 cm×2 cm. The plate can be made of PVC or other polymer, as well as of wood or metal. The plate dimensions can be bigger or smaller than recommended. There is 4 holes of 1.3 cm diameter disposed at regular intervals between them and aimed for threaded rods fixing with lock nuts and washers. There is 4 mm deep socket on one side of the plate aimed for string screw. Each end plate has 10 small holes aimed for string running through. Recommended distance between holes 1 cm and the number of holes as necessary can be larger or smaller than recommended. Recommended distance between holes is 1 cm, but other distance can be applied depending of the plate and string materials and their characteristics.

The invention claimed is:

1. Subsidiary element for floorball training rink arrangement that is made as latticework formed by: two parallel end plates; several threaded rods as stiffening members; two elastic string structures disposed in two parallel planes between the two end plates and orthogonal to the two end plates, wherein each of the string structures present one side of mentioned latticework, where the strings are arranged parallel to each other without touching each other, wherein the threaded rods are arranged between the two parallel end plates and attached thereto, and the threaded rods are disposed between the two string structures so that during use a ball can touch one of the two string structures without touching the threaded rods, and wherein each end plate is provided with:

holes, in which threaded rods are inserted and fastened thereto by means of washers assuring rigidity and load bearing capacity of the subsidiary element;

holes, in which strings are criss-cross stringed in two parallel planes and each string of the string structure is attached to the end plates independently one from another so that the string structure is pretensioned.

2. Subsidiary element for floorball training rink arrangement as per claim 1, wherein the strings in the string structure are parallel and spacing between the strings is 1 cm; length of string structure between end plates is 75 cm; spacing between the string structure and rink surface, on which the subsidiary element may be positioned, is 2 cm; a number of strings in each structure is 9; the strings can be synthetic or natural, made of metal, polymer as well as textile cord with diameter 1 to 1.4 mm.

3. Subsidiary element for floorball training rink arrangement as per claim 1, wherein threaded rods, which assure bearing capacity of proposed element design against stringing load and ball strikes, fastened at the end plates of the subsidiary element; recommended length of threaded rods of 12 mm diameter is 81 cm, number—4 pcs., and spacing, measured between their axes, 9 cm.

4. Subsidiary element for floorball training rink arrangement as per claim 1, wherein dimensions of plates are as follows 12 cm×20 cm×2 cm; plates can be made of PVC or other polymer material, as well as of wood or metals; each mentioned plates has four evenly spaced holes of 1.3 cm diameter aimed for threaded rods fastening with nuts and washers; on one side of the mentioned plates made 4 mm deep sockets for string fastening screws; there are 10 small holes spaced 1 cm on each plate aimed for string running through; distance of holes centres from the plate side edge is 1 cm.

5. Subsidiary element for floorball training rink arrangement as per claim 1, wherein string end eyes are fastened to the screws arranged on the end plates.

6. Subsidiary element for floorball training rink arrangement as per claim 1, wherein the subsidiary element is provided with aluminium tubes for threaded rods masking, which increase the element resistance against stringing load as well as against ball strikes; wherein length of the tubes is 75 cm, a number of the tubes in the subsidiary element is 4, diameter of the tubes is 14 mm and spacing between the tubes is 8 cm, wherein the threaded rods are fastened at end plates by lock nuts with washers.

7. Application of subsidiary elements for floorball training rink arrangement as per claim 1 by installing the subsidiary elements in different orders on floorball rink, so that symmetric two sides structure of subsidiary element can be used by two players for game skill practicing in work-out sessions.

8. Application of proposed design of subsidiary element for floorball training rink arrangement and use in work-out sessions according to claim 7, by disposing necessary number of elements on the rink in different orders and combinations: in line connecting end to end, in zigzag line connecting end to end and/or one over another.

9. Application of proposed design of subsidiary element as per claim 1 for floorball training rink perimeter fencing and use in work-out sessions.

* * * * *